US009611093B2

(12) United States Patent
Baumer

(10) Patent No.: US 9,611,093 B2
(45) Date of Patent: Apr. 4, 2017

(54) DEBRIS DISPOSAL SYSTEM

(71) Applicant: Skamp Containment Systems LLC, Pittsboro, IN (US)

(72) Inventor: Michael Lee Baumer, Pittsboro, IN (US)

(73) Assignee: Skamp Containment Systems LLC, Pittsboro, IN (US)

( * ) Notice: Subject to any disclaimer, the term of this patent is extended or adjusted under 35 U.S.C. 154(b) by 73 days.

(21) Appl. No.: 14/716,033

(22) Filed: May 19, 2015

(65) Prior Publication Data

US 2016/0340115 A1 Nov. 24, 2016

(51) Int. Cl.
*B65F 1/00* (2006.01)
*B65F 1/16* (2006.01)
*B65F 1/08* (2006.01)

(52) U.S. Cl.
CPC ..... *B65F 1/0093* (2013.01); *B65F 1/08* (2013.01); *B65F 1/16* (2013.01); *B65F 1/163* (2013.01); *B65F 1/1623* (2013.01); *B65F 1/1646* (2013.01)

(58) Field of Classification Search
CPC ..... B65F 1/16; B65F 1/163; B65F 1/1646; B65F 1/1623; B65F 1/1468; B65F 1/08; B65F 1/0093
USPC ..... 220/908, 484, 366.1; 232/43.5
See application file for complete search history.

(56) References Cited

U.S. PATENT DOCUMENTS 2,329,737 A 9/1943 Aragona
2,528,056 A 10/1950 Henry
3,800,973 A * 4/1974 Weaver ..... B65F 1/1457 187/345
4,186,844 A * 2/1980 Swanson ..... B65F 1/16 220/817
4,727,855 A 3/1988 Morsette
4,756,445 A * 7/1988 Agee, Sr. ..... B65F 1/08 220/23.89
4,813,575 A 3/1989 O'Connor
4,930,653 A * 6/1990 Machado ..... B65F 1/141 220/23.4
5,203,618 A 4/1993 Oshall
5,417,338 A * 5/1995 Roy ..... B65F 1/006 220/23.4
6,026,972 A 2/2000 Makowski
6,039,206 A * 3/2000 DeFrancesco ..... A47G 23/0225 220/23.87
6,257,436 B1 * 7/2001 McGlauflin ..... B65D 25/06 206/223
6,513,671 B2 2/2003 Dicello et al.
6,772,566 B1 * 8/2004 Machledt ..... H02G 9/10 220/4.02
6,874,836 B1 * 4/2005 Feser ..... B60N 3/08 220/839
6,895,719 B1 5/2005 Herbert
6,899,243 B1 5/2005 Gotesson
8,015,928 B2 9/2011 Chen
(Continued)

*Primary Examiner* — Brian Glessner
*Assistant Examiner* — Paola Agudelo
(74) *Attorney, Agent, or Firm* — Woodard, Emhardt, Moriarty, McNett & Henry LLP

(57) ABSTRACT

A debris disposal system mountable to an upwardly facing supporting surface such as a floor or bench top. A first container is fixedly mounted to the supporting surface and receives a removable second container having a lid which when open allows the debris to be swept into the second container.

10 Claims, 8 Drawing Sheets

(56) References Cited

U.S. PATENT DOCUMENTS

| | | | | |
|---|---|---|---|---|
| 8,544,648 | B2 * | 10/2013 | Cleveland | B65D 21/0223 206/503 |
| 9,150,353 | B2 * | 10/2015 | Jackson | B65F 1/141 |
| 2005/0023280 | A1 * | 2/2005 | Kondo | B60R 11/00 220/263 |
| 2008/0000912 | A1 * | 1/2008 | Lin | B65F 1/06 220/495.08 |
| 2009/0289060 | A1 * | 11/2009 | Renard | B65F 1/068 220/23.88 |
| 2011/0089179 | A1 * | 4/2011 | Flewelling | B65F 1/006 220/524 |
| 2014/0117004 | A1 | 5/2014 | Sambonet | |
| 2014/0367389 | A1 * | 12/2014 | Madrid | B65F 1/06 220/495.07 |
| 2015/0076974 | A1 | 3/2015 | Schreiter | |

* cited by examiner

DEBRIS DISPOSAL SYSTEM

BACKGROUND OF THE INVENTION

Field of the Invention

This invention is in the field of static structures, such as buildings, cabinets and other fixed structures having debris collection systems.

Description of the Prior Art

Debris present on a floor may be swept up by a variety of sweepers and other such machines or may be collected via the traditional broom and dust pan combination. Similarly, debris existing on a counter top or bench may be collected into a bag or other similar object and then disposed in a collection area.

A floor mounted disposable system is disclosed in U.S. Pat. No. 6,895,719 which has a floor mounted housing adapted to be mounted over an opening formed in the floor for receiving the debris swept therein. A receptacle located beneath the floor then receives the debris.

In U.S. Pat. No. 4,727,855 there is disclosed a fireplace ash disposal device having an opening flush with the floor of a fireplace which leads to a chute below the fireplace so the ash may then be subsequently removed.

In lieu of mounting a debris receptacle to a floor, U.S. Pat. No. 6,026,972 discloses a bag holding frame which mounts to the edge of a cutting board so waste materials may be swept off the cutting board through an opening of the collector with the waste materials then falling into the bag for subsequent removal.

In U.S. Pat. No. 6,874,836 there is disclosed a two-container system for receiving manually placed trash. One container is fixedly mounted to a vehicle such as a golf cart with the second container insertable within the first container. The debris is then placed in the second container. Once the second container is full, it may be removed from the first container to discard the debris.

Despite the many debris disposal systems, there is a need for a debris disposal system that may be mounted in upwardly facing surface of the floor, countertop or bench to enable the debris to be quickly brushed into the system receptacle. The opening must be flush with the receptacle supporting surface to insure all the debris is quickly swept into a cavity formed by the receptacle. Further, the system must provide for easy removal of the receptacle for emptying purposes while being attractive but unobtrusive. Disclosed herein is such a system.

SUMMARY OF THE INVENTION

A debris disposal system mountable to an upwardly facing supporting surface and having an entrance to receive debris aligned with the supporting surface. The system has a structure fixedly mounted to the supporting surface and extends downwardly therefrom. The structure has a front portion and back portion with space positioned therebetween.

A receptacle is extendable into and removably held in the space of the structure. The receptacle has a receptacle front wall, a receptacle rear wall, receptacle side walls and a receptacle bottom wall joined together forming a box. The receptacle further having a lid with an open position allowing debris to be swept across a supporting surface into the box and a closed position to limit debris from escaping therefrom. A spring device is mounted to the receptacle and has an extension engaged with the lid normally urging the lid to open but yieldable to allow the lid to be moved to the closed position.

It is an object of the present invention to provide a debris/refuse collector which is mounted flush with the floor, countertop or other supporting surface into which the debris/refuse may be swept.

A further object of the present invention is to provide a debris receiver having an unobstructed entry through which the debris may be swept from the surface supporting the receiver.

A further object of the present invention is to provide a debris collector that is easily removed from the debris surface for emptying the debris from the container.

An additional object of the present invention is to provide a system for collecting debris present on floors, counter tops, and benches as well as other supporting surfaces that may be used in a variety of industries including the medical industry and the food industry.

Yet a further object of the present invention is to provide a debris receptacle that is concealed when not in use.

An additional object of the present invention is to provide a debris receptacle that is positioned within an air duct of an HVAC system.

Related objects of the present invention will be apparent in the following description.

DESCRIPTION OF THE PREFERRED EMBODIMENTS

Figure 1:
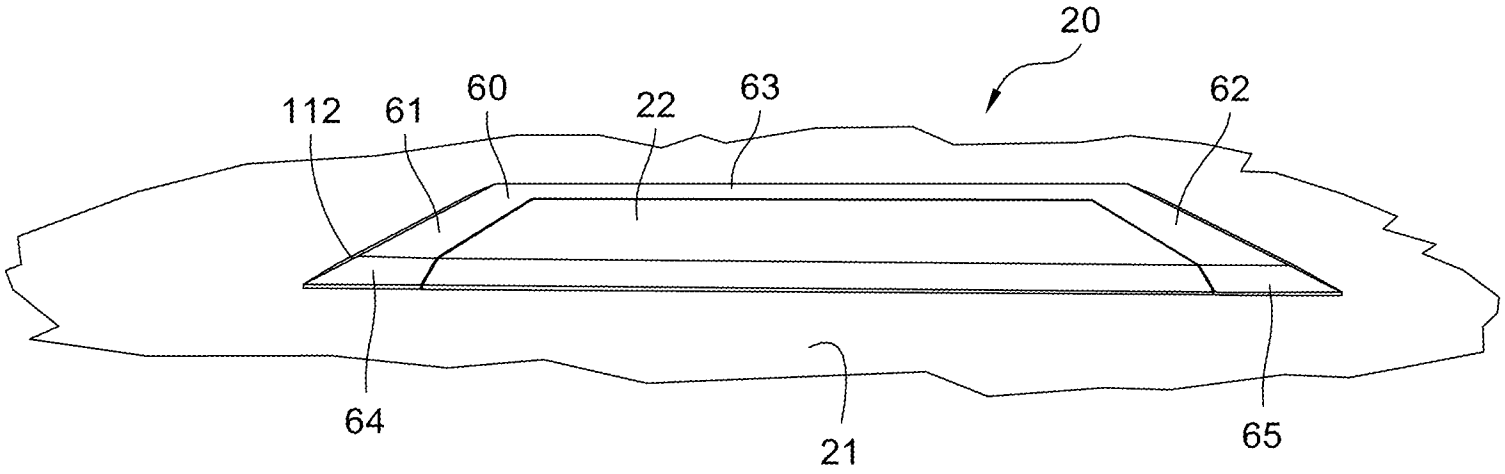
FIG. 1 is a front perspective view of an alternate embodiment of the debris disposal system of the present invention with the lid in the closed position.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
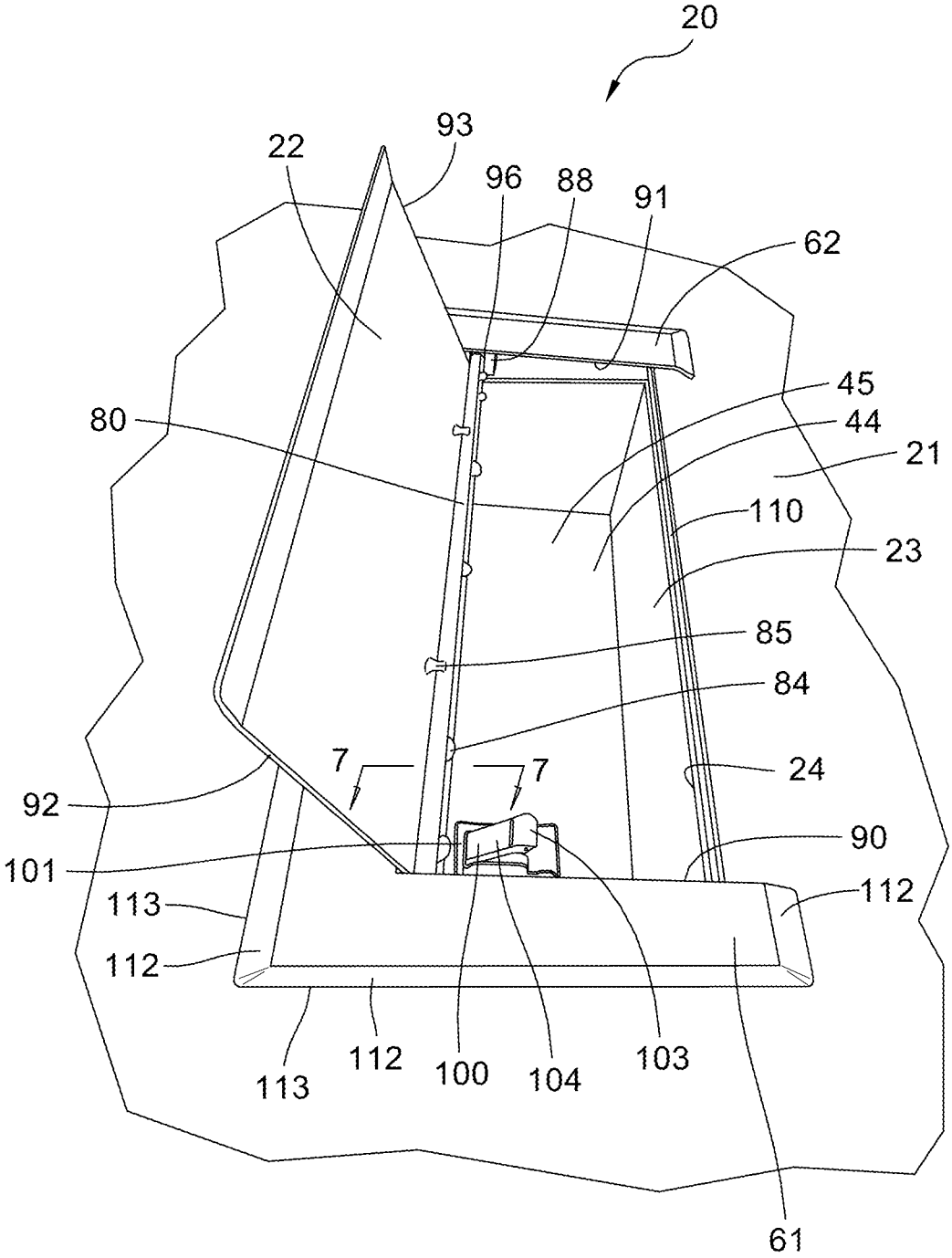
FIG. 2 is a top perspective view of the debris disposal system with the lid in the open position.

Referring now more particularly to FIGS. 1 and 2, there is shown an alternative embodiment of the present invention including a debris disposal system 20 mounted to an upwardly facing support surface 21, such as a floor, top surface of a bench, counter top or other surface. System 20 includes a pivotally mounted lid 22 shown in the closed position in FIG. 1 and the open position in FIG. 2.

Figure 3:
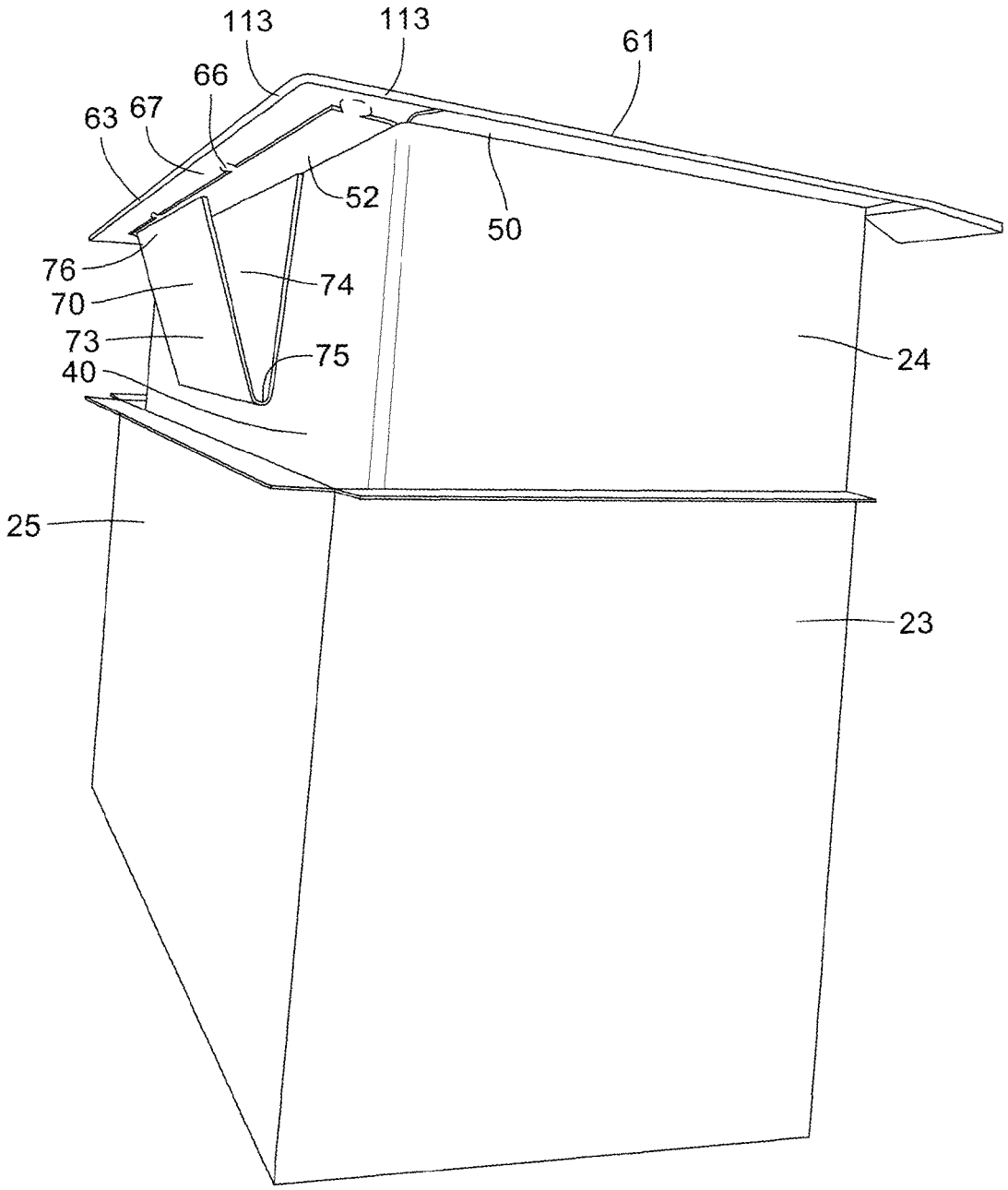
FIG. 3 is an enlarged side perspective view of the debris receptacle extending partially into the permanently mountable container.

The debris disposal system 20 consists of a pair of box-shaped containers or receptacles 23 and 24 (FIG. 3) that are matable together. Container 23 is a structure that is fixedly mounted to the supporting surface 21 and extends downwardly therefrom. The structure provides an upwardly opening container into which the debris receptacle 24 (FIG. 3) is insertable. While structure 23 is fixedly mounted to the supporting surface 21, the receptacle 24 is removably inserted into structure 23.

Figure 4:
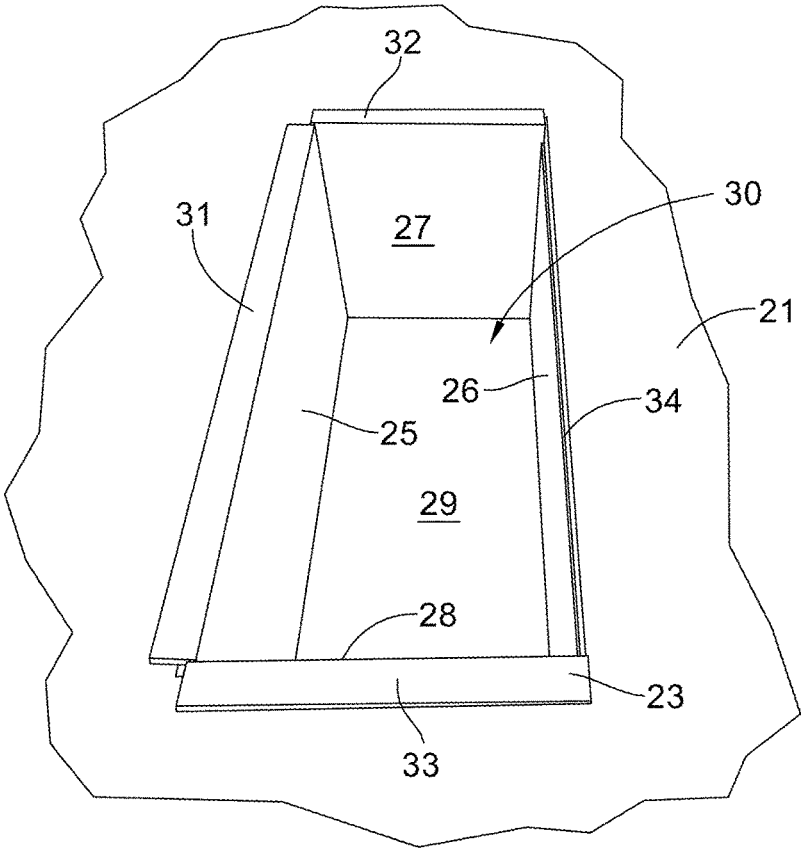
FIG. 4 is a top perspective view of the container mounted to the supporting surface, such as a floor or counter top.

Structure 23 (FIG. 4) includes a back portion or wall 25 and a front portion or wall 26 connected to side walls 27 and 28. The walls are spaced apart forming a cavity 30 into which receptacle 24 is removably insertable. The bottom wall 29 of structure 23 is connected to walls 25-28 thereby providing a debris collection area in the event receptacle 24 is removed and debris accidently falls into cavity 30. Flange 31 is integrally and perpendicularly joined to back wall 25 and extends rearwardly of the wall. Likewise, a pair of flanges 32 and 33 is integrally joined and perpendicularly arranged relative to walls 27 and 28 and extends outwardly of the side walls. Walls 31-33 extend over and rest atop surface 21 thereby supporting structure 23 relative to the upwardly facing surface 21. Flanges 31-32 may be affixed to surface 21 by any number of conventional means such as by fasteners or adhesives. Notably, the front wall 26 does not have a flange attached thereto. Instead, the top edge 34 of wall 26 is positioned below surface 21 forming a channel 110 (FIG. 2) for receiving adhesive.

Figure 5:
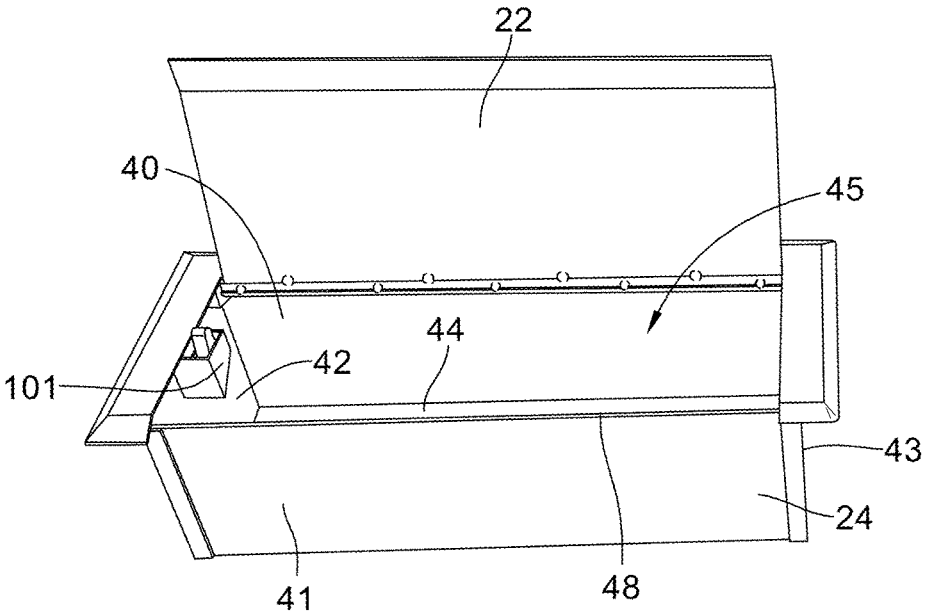
FIG. 5 is a top perspective view of the debris receptacle removed from the container.

Receptacle 24 (FIG. 3) is removable from container 23 and has a box-like configuration with a lid pivotally mounted thereto. Receptacle 24 (FIG. 5) includes a receptacle rear wall 40, a receptacle front wall 41 and a pair of receptacle side walls 42 and 43 connected together. Likewise, walls 40-43 are connected to the receptacle bottom wall 44 (FIG. 2) thereby forming a cavity 45 into which the debris existing on the supporting surface 21 may be swept.

Figure 6:
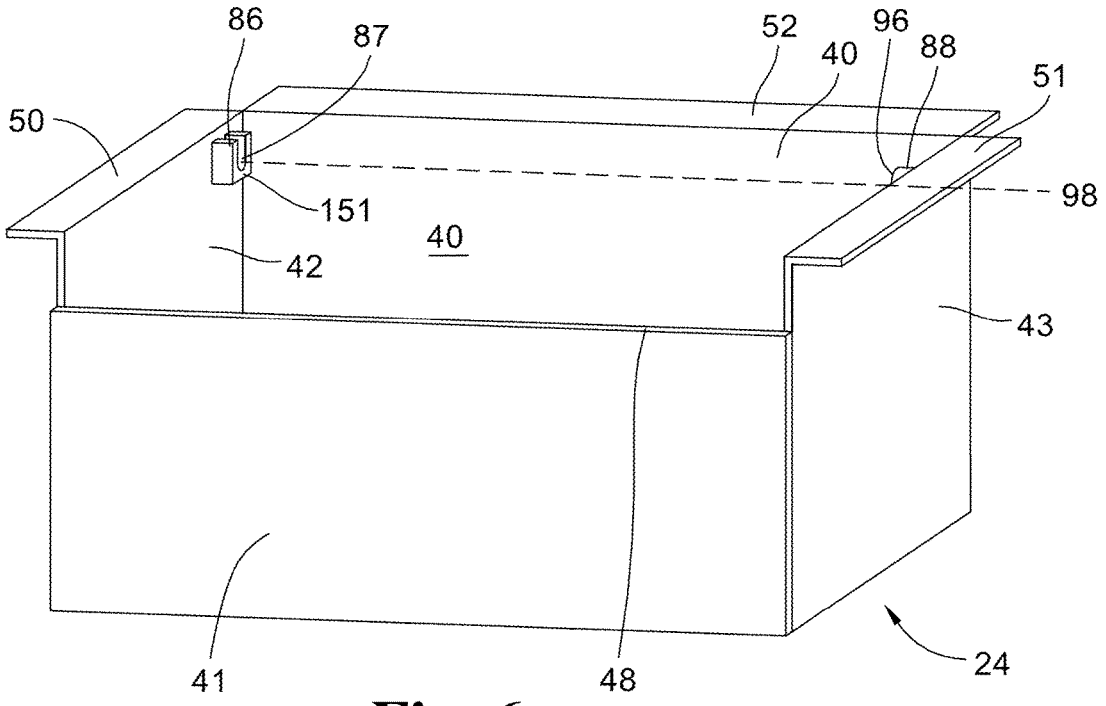
FIG. 6 is a front perspective view of the container. The lid and axle along with the lid spring and assorted bracket is not shown so the receptacle can be clearly shown.

Receptacle 24 is shown in FIG. 6 without the lid or associated mechanism. Receptacle 24 includes a pair of side flanges 50 and 51 integrally and perpendicularly joined to side walls 42 and 43. A rear flange 52 is integrally and perpendicularly joined to rear wall 40. The top edge 48 of front wall 41 is located approximately one inch below flanges 50 and 51 and is also positioned beneath the front edge 34 (FIG. 4) of container 23. In one embodiment, container 23 is mounted to the floor or a bench upwardly facing surface 21 so that edge 34 is positioned a first distance or approximately one-half inch below supporting surface 21. In addition, when receptacle 24 is fully inserted into container 23, edge 48 (FIG. 6) is positioned a second distance or approximately one inch below the upwardly facing supporting surface 21 which is greater than the positioning of the container edge 34 relative to surface 21 thereby allowing debris to be swept off of surface 21 and over edges 34 and 48 without being impeded by the edges. Notably, front wall 41 does not have a flange mounted to the top edge thereof with flanges 50-52 being positioned atop flanges 33, 31 and 32 of container 23.

A C-shaped cover 60 (FIGS. 1 and 2) is fixedly fastened to flanges 50-52 of receptacle 24. Cover 60 has a pair of parallel arms 61 and 62 extending over and affixed to respectively flanges 50 and 51. Cover 60 has a middle arm 63 extending over and affixed to rear flange 52 of receptacle 24. Cover middle arm 63 is located between and joins together the parallel side arms 61 and 62. The lid 22 (FIG. 11) is located between parallel arms 61 and 62 and adjacent middle arm 63 when in the closed position. The upwardly facing surfaces of each arm 61-63 extend downwardly and outwardly providing a beveled surface 112. Surface 112 extends downward to the distal edge 113 (FIG. 2) of each arm. Edge 113 (FIG. 3) is positioned atop supporting surface 21 having outer edges in contact with supporting surface 21.

Ends 64 and 65 of arms 61 and 62 are spaced apart forming an entrance into the cavity formed by receptacle 24 allowing the debris to be swept off of supporting surface 21 and through the entrance aligned with supporting surface 21 between arm ends 64 and 65 when the lid is in the open position. The downwardly facing surfaces of arms 61-63 are welded to the outwardly extending flanges 50-52 of receptacle 24. For example, spot weld 66 (FIG. 3) fixedly secures the downwardly facing surface 67 of middle arm 63 to flange 52.

A spring device 70 (FIG. 3) is mounted to the rearwardly facing surface of receptacle rear wall 40. The spring device consists of a pair of flanges 73 and 74 integrally joined together at their adjacent ends 75 forming a V-shape configuration. Flange 74 is fixedly attached to wall 40 whereas flange 73 extends outwardly therefrom and is spring biased forming a space between flanges 73 and 74. The top edge portion 76 of flange 73 is in contact with the inwardly facing surface of wall 25 (FIG. 4) of container 23 when receptacle 24 is fully inserted into the container. Top edge portion 76 thereby urges the entire receptacle in a forward direction to maintain contact between front wall 26 of container 23 and front wall 41 of receptacle 24 thereby ensuring that debris does not fall downwardly between receptacle front wall 41 and container front wall 26. Flange 73 is movable towards flange 74 when receptacle 24 is moved slightly away from the front wall of container 23 and pulled upwardly to remove the receptacle for emptying of debris therein.

Figure 7:
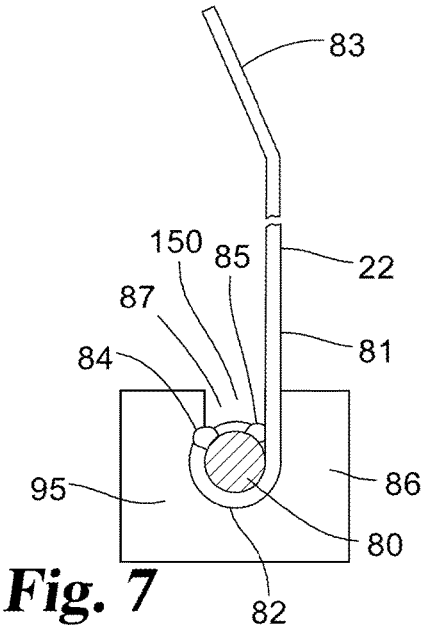
FIG. 7 is an enlarged cross-sectional view taken along the line 7-7 of FIG. 2 and viewed in the direction of the arrows.

Lid 22 (FIG. 7) is pivotally mounted to the side walls 42 and 43 (FIG. 6) by means of an axle 80 having its opposite ends rotatably and slidably mounted in yokes or slots 87 provided in plates 86 fixedly secured to the mutually facing interior surfaces of side walls 42 and 43. Lid 22 has a sheet configuration with its proximal end 82 partially wrapped around and affixed to axle 80. In the embodiments shown in the drawings, the proximal end 82 extends approximately 180 degrees around axle 80 with the edge of the proximal end 82 affixed to axle 80 by welds 84 and with the main portion 81 of the lid being affixed to axle 80 by welds 85. Thus, when axle 80 rotates in holes 87, lid 22 will pivot back and forth between the closed position and the open position.

Slots 87 (FIG. 7) have a U-shape configuration being closed at the bottom 151 (FIG. 6) of each slot but open at the top 150 of each slot. Thus, axle 80 is allowed to not only rotate in each slot but also to move vertically up and down in each slot. When the lid is in the closed position, axle 80 is located at the top 150 of each slot. In order to move the lid to the open position, the portion of the lid immediately over slots 87 is pressed downwardly either by hand or by stepping thereon forcing axle 80 downwardly in each slot to the bottom closed ends 151 of the slots thereby causing the axle and lid to rotate. The distal end 115 of the lid is then grasped and pulled upwardly thereby causing axle 80 to further rotate until the lid is in the open position. As the lid is closed, the axle moves to the top ends 150 of slots 87.

The mutually facing edges 90 and 91 of arms 61 and 62 (FIG. 2) are spaced apart from the outwardly facing edges 92 and 93 of lid 22 thereby preventing interference with the movement of lid 22 relative to arms 61 and 62. The mutually facing surfaces 95 and 96, respectively of plate 86 (FIG. 7) and plate 88 (FIG. 2) are spaced apart a distance less than the distance between cover arm edges 90 and 91 and just slightly greater than the width of the lid which extends from lid edge surface 92 to lid edge surface 93 (FIG. 2). Thus, the lid edge surfaces 92 and 93 will contact the surfaces 95 and 96 instead of the arm edges 90 and 91 in the event the lid and rod move laterally along the axis of rotation 98 of rod 80. Since only small portions of the lid edge surfaces 92 and 93 are contacted by the relatively small plates 86 and 88, the resulting interference is sufficiently small to not impede movement of the lid as contrasted if the lid were to contact arm edges 90 and 91.

Spring device 100 (FIG. 2) is a commercially available component available from Uxcell.com under part no. A140716000UX0761 or from Jineli Hardware Products Co., Ltd of Guangdon G, China under part No. C-32. These spring devices are typically utilized for closure of a cabinet cupboard wherein by depressing the cabinet door, the spring will be depressed unlocking the spring and forcing the door to an open position. Spring device 100 (FIG. 2) is mounted within a three-sided enclosure 101 (FIG. 5) affixed to the sidewall 42 of the receptacle. An upwardly extending arm 104 (FIG. 2) has a distal end with a roller 103 rotatably mounted thereto for engaging the downwardly facing surface of lid 22 for forcing the lid open after the lid is pressed downwardly releasing arm 104. A variety of other types of spring devices may be utilized having a spring biased member that extends upwardly contacting lid 22 but when depressed releases the spring thereby forcing the lid upwardly to the open position. Likewise, when the lid is manually moved downward from the open position, the spring device will return to its locked position.

Figure 8:
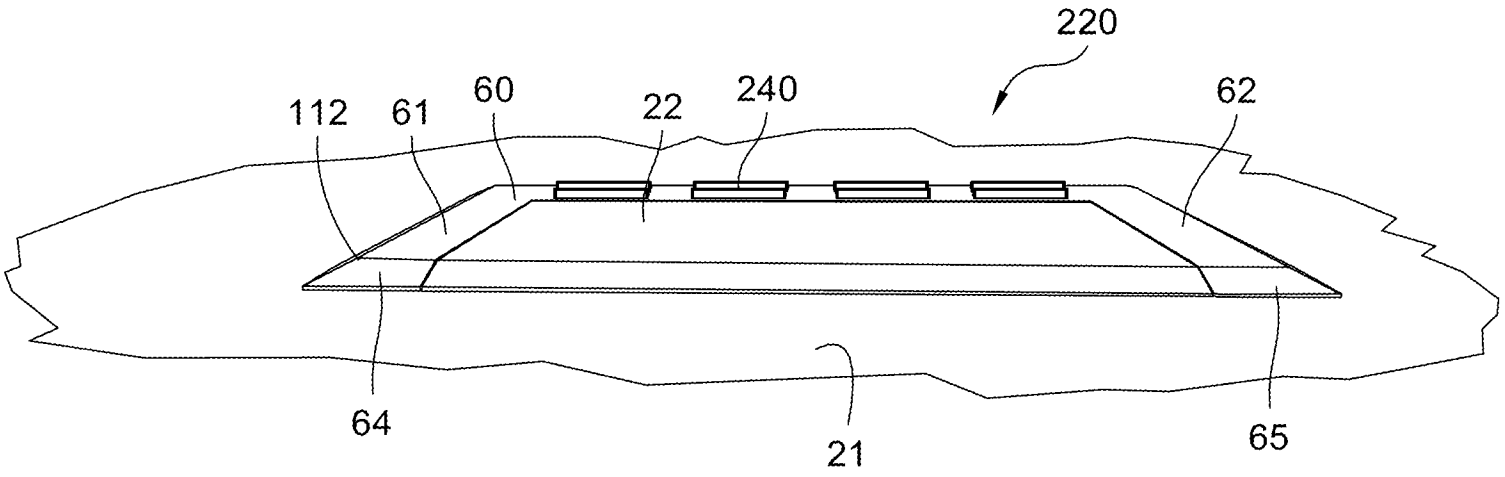
FIG. 8 is a front perspective view of the preferred embodiment of the debris disposal system of the present invention with the lid in the closed position.
Figure 9:
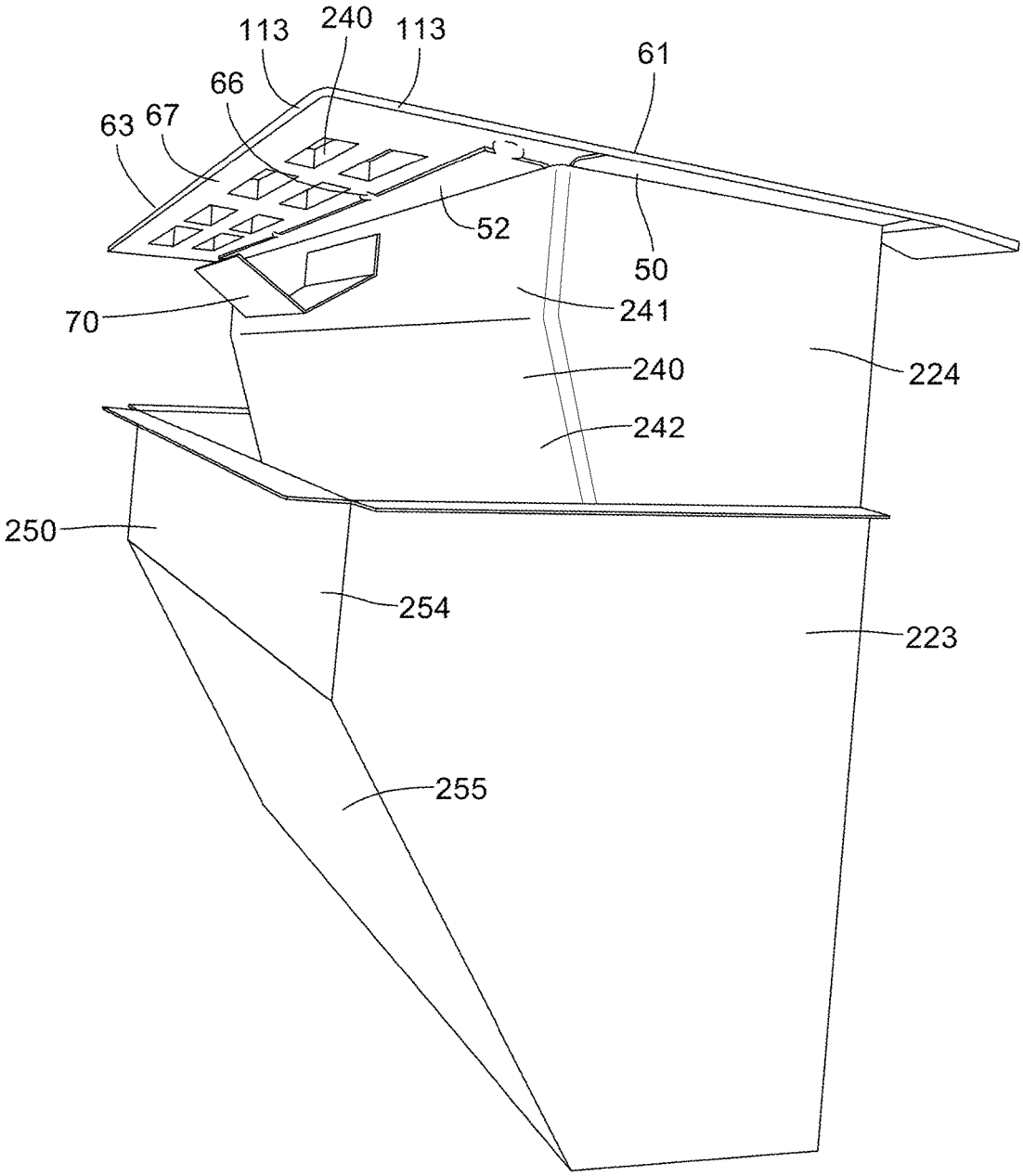
FIG. 9 is an enlarged side perspective view of the debris receptacle of FIG. 8 extending partially into the permanently mountable container.
Figure 10:
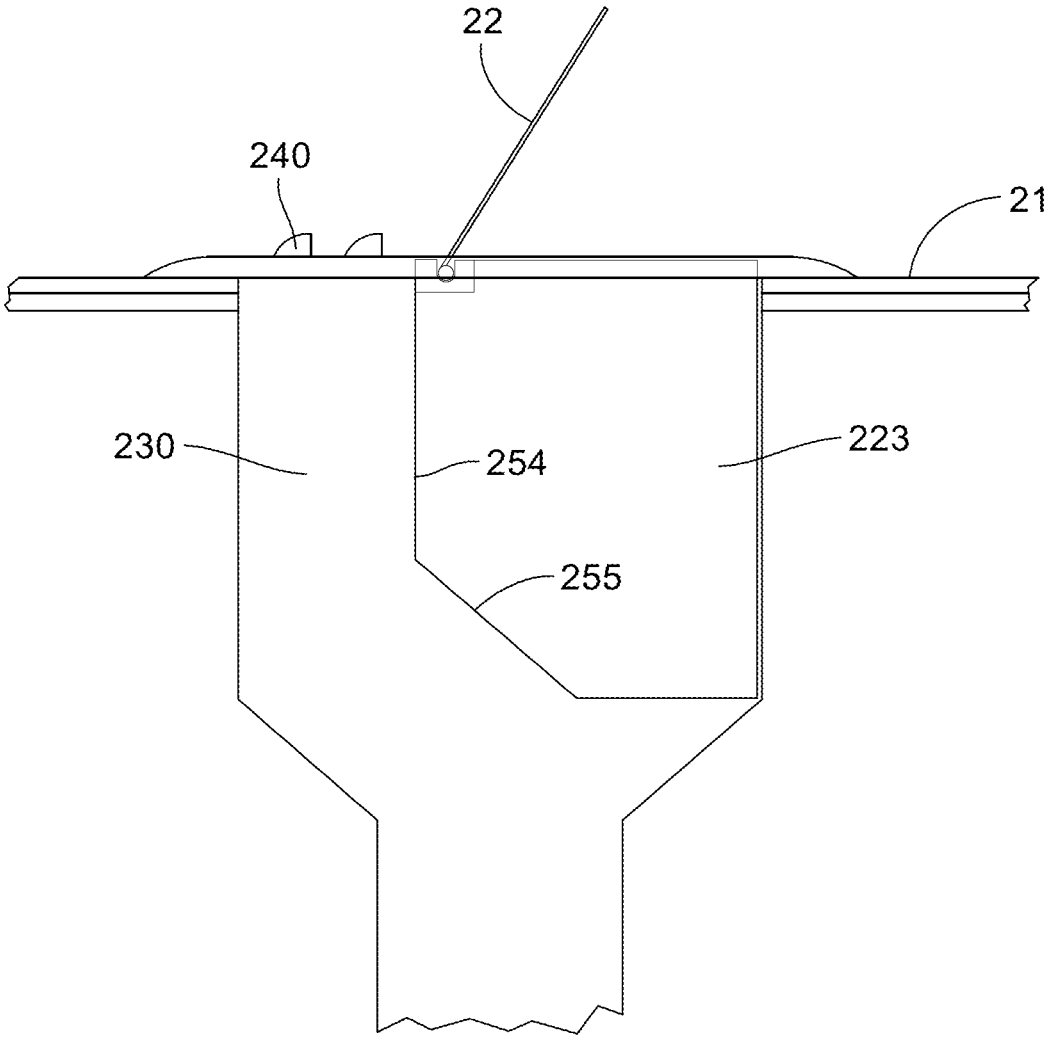
FIG. 10 is an enlarged side view of the debris receptacle and container of FIG. 9 mounted in a HVAC register duct.

The preferred embodiment 220 of the present invention is shown in FIGS. 8-10. The preferred embodiment is identical to the alternative embodiment 20 of FIGS. 1-7 except the cover 60 of the preferred embodiment includes louvers 240 to allow ventilation, and the receptacle 224 and container 223 (FIG. 9) are shaped to fit within a register duct 230 (FIG. 10) of a Heating Ventilation and Air Conditioning (HVAC) system. The alternative embodiment of the debris receptacle fits within a cavity in the floor or counter-top and is not associated with an HVAC system.

Cover 60 is C-shaped and is identical for both embodiments except the preferred embodiment has louvers extending through the back flange or middle arm 63 (FIG. 9) which is connected to the side arms 61 and 62 forming holes through the middle arm allowing air to flow there through from the air duct 230. Duct 230 is a standard duct connected to a HVAC system. The register cover normally covering the outlet of duct 230 is removed and replaced with the preferred embodiment of the debris system 220.

Container 223 has a pair of side walls connected to a front wall, bottom wall and rear wall forming a cavity into which receptacle 224 is inserted. Container 223 is identical to container 23 except the rear wall 250 consists of a vertical wall portion 254 joined to an inclined wall portion 255 with the container sized to fit within the HVAC air duct 230 (FIG. 10) while spacing wall portions 254 and 255 (FIG. 9) apart from the duct rear wall allowing the air to flow upwardly through the louvers 240 extending through the middle arm 63 of cover 60. The cover 60 having the louvers 240 thereon is attached to the flanges of the receptacle 224 in an identical manner as the attachment of cover to receptacle 24 previously detailed herein.

Receptacle 224 (FIG. 9) is identical to receptacle 24 (FIG. 3) except it is shaped to fit within container 223. Thus, the rear wall 240 of receptacle 224 has a vertical wall portion 241 and an inclined wall portion 242 to be positioned adjacent to and inward of wall portions 254 and 255 of the bottom container 223. Retainer spring 70 is mounted to the rear wall of the receptacle 24 for the embodiment of FIG. 3 and also mounted to the rear wall portion 241 of receptacle 224 for the embodiment of FIG. 9 in an identical manner to contact the rear wall of container 223 and urge the receptacle forward limiting passage of debris between the front walls of receptacle 224 and container 223.

The preferred embodiment includes the identical spring device 100 previously described for the alternative embodiment and operates to force the lid open when the lid is depressed by forcing the lid down over slots 87. Likewise, the cover is attached to axle in the same manner for both embodiments.

While the invention has been illustrated and described in detail in the drawings and foregoing description, the same is to be considered as illustrative and not restrictive in character, it being understood that only the several embodiments have been shown and described and that all changes and modifications that come within the spirit of the invention are desired to be protected.

What is claimed is:

1. A debris disposal system mountable to an upwardly facing supporting surface and having an entrance aligned with the supporting surface to receive debris, comprising:

a structure mountable to a supporting surface for extending downwardly therefrom, said structure having a front portion and back portion with space positioned therebetween;

a receptacle extendable into and removably held in said space of said structure, said receptacle having a receptacle front wall, a receptacle rear wall, receptacle side walls and a receptacle bottom wall joined together forming a box, said receptacle further having a lid pivotably mounted to said receptacle with an open position allowing debris to be swept across the supporting surface into said box and a closed position to limit debris from escaping therefrom;

a first spring device having an extension engaged with said lid to urge said lid to open but yieldable to allow said lid to be moved to said closed position; and, a second spring device positioned between said back portion of said structure and said rear wall of said receptacle to urge said front wall of said receptacle against said front portion of said structure but yieldable to allow said receptacle to be moved away from said front portion as the box is removed from said structure; and wherein, said second spring device includes a v shaped bracket having a first wall fixedly mounted and a second wall joined to said first wall but extending outwardly therefrom forming with said first wall a v-shape, said second wall spring biasing said receptacle forward so said front wall of said receptacle is in contact with said front portion of said structure.

2. A debris disposal system mountable to an upwardly facing supporting surface and having an entrance aligned with the supporting surface to receive debris, comprising:

a structure mountable to a supporting surface for extending downwardly therefrom, said structure having a front portion and back portion with space positioned therebetween; and a receptacle extendable into and removably held in said space of said structure, said receptacle having a receptacle front wall, a receptacle rear wall, receptacle side walls and a receptacle bottom wall joined together forming a box, said receptacle further having a lid pivotably mounted to said receptacle with an open position allowing debris to be swept across the supporting surface into said box and a closed position to limit debris from escaping therefrom;

a first spring device having an extension engaged with said lid to urge said lid to open but yieldable to allow said lid to be moved to said closed position; and a second spring device positioned between said back portion of said structure and said rear wall of said receptacle to urge said front wall of said receptacle against said front portion of said structure but yieldable to allow said receptacle to be moved away from said front portion as the box is removed from said structure; and wherein:

said front portion of said structure has a first top edge positionable a first distance below the upwardly facing surface, said front wall of said receptacle has a second top edge positionable a second distance below the upwardly facing surface with said second distance greater than said first distance allowing debris to be swept off of said upwardly facing surface and over said first top edge and said second top edge into said box when said lid is open, said structure is an upwardly opening container with a container front wall and a container back wall forming respectively said front portion and said back portion, said structure has container side walls connected to said container front wall and said container back wall, said container side walls have side flanges perpendicularly joined thereto, said container back wall has a flange perpendicularly joined thereto with said flanges and said flange restable atop the upwardly facing supporting surface and supporting said container thereon, said first top edge is on said container front wall and is positioned beneath said upwardly facing surface forming a sealing channel between said structure and said upwardly facing surface.

3. The debris disposal system of claim 2 wherein:

said receptacle side walls and said receptacle rear wall extend outwardly over said flanges and said flange of said container; and, said lid has a proximal end portion and a distal end portion; and wherein the system further comprising:

a C-shaped cover with a pair of parallel arms extending over and affixed to said flanges and a middle arm extending over and affixed to said flange with said middle arm located between and joining together said parallel arms, said lid located between said parallel arms when in said closed position and extending over said first edge and said second edge, said arms and said middle arm have upwardly facing surfaces extending downwardly and outwardly from said lid providing a beveled surface on said cover, said parallel arms are spaced apart adjacent said lid distal end portion of said lid forming an entrance to said receptacle.

4. The debris disposal system of claim 3 wherein said cover includes a plurality of louvers extending therethough to allow air flow from beneath said receptacle and through said cover.

5. The debris disposal system of claim 3 and further comprising:

an HVAC air duct mountingly receiving said structure and receptacle therein through which air flow extends through said louvers.

6. A debris disposal system mountable to an upwardly facing supporting surface and having an entrance to receive debris aligned with the supporting surface, comprising:

a structure mounted to a supporting surface and extending downwardly therefrom, said structure having a front portion and back portion with space positioned therebetween; and, a receptacle extendable into and removably held in said space of said structure, said receptacle having a receptacle front wall, a receptacle rear wall, receptacle side walls and a receptacle bottom wall joined together forming a box;

a lid having an open position allowing debris to be swept across the supporting surface into said box and a closed position to limit debris from escaping therefrom;

a first spring device mounted adjacent said rear wall of said receptacle and said back portion of said structure to urge said front wall of said receptacle against said front portion of said structure but yieldable to allow said receptacle to be moved away from said front portion as said receptacle is removed from said structure; and, a second spring device having an extension engageable with said lid to urge said lid to open but yieldable to allow said lid to be moved to said closed position, and wherein:

said front portion of said structure has a first top edge positioned a first distance below the upwardly facing surface, said front wall of said receptacle has a second top edge positioned a second distance below the upwardly facing surface with said second distance greater than said first distance allowing debris to be swept off of said upwardly facing surface and over said first top edge and said second top edge into said box when said lid is open.

7. The debris disposal system of claim 6 said structure is an upwardly opening container with a container front wall and a container back wall forming respectively said front portion and said back portion, said structure has container side walls connected to said container front wall and said container back wall, said container side walls have side flanges perpendicularly joined thereto, said container back wall has a flange perpendicularly joined thereto with said flanges and said flange restable atop the upwardly facing supporting surface and supporting said container thereon, said first top edge is on said container front wall and is positioned beneath said upwardly facing surface forming a sealing compound receiving channel; and wherein said container is configured to fit within an HVAC duct.

8. A debris disposal system mountable to an upwardly facing supporting surface and having an entrance to receive debris aligned with the supporting surface, comprising:

a structure mounted to a supporting surface and extending downwardly therefrom, said structure having a front portion and back portion with space positioned therebetween; and, a receptacle extendable into and removably held in said space of said structure, said receptacle having a receptacle front wall, a receptacle rear wall, receptacle side walls and a receptacle bottom wall joined together forming a box;

a pivotably mounted lid having an open position allowing debris to be swept across a supporting surface into said box and a closed position to limit debris from escaping therefrom;

a spring device engaged with said lid to assist opening and closing of said lid; and, a v-shaped bracket having a first leg fixedly mounted to said receptacle and a second leg integrally joined to said first leg and spring biased against said structure to urge said front wall of said receptacle against said front portion of said structure to limit debris from falling therebetween as said debris is swept off of said supporting surface into said receptacle.

9. A debris disposal system mountable to an upwardly facing supporting surface, and having an entrance to receive debris aligned with the supporting surface, comprising:

a structure mounted to a supporting surface and extending downwardly therefrom, said structure having a front portion and back portion with space positioned therebetween; and, a receptacle extendable into and removably held in said space of said structure, said receptacle having a receptacle front wall, a receptacle rear wall, receptacle side walls and a receptacle bottom wall joined together forming a box;

a pivotably and slidably mounted lid having a rod mounted to said receptacle side walls and having an open position allowing debris to be swept across a supporting surface into said box and a closed position to limit debris from escaping therefrom said lid includes opposite edges; and, a spring device engaged with said lid to assist opening and closing of said lid; and, a cover fixedly mounted to said receptacle adjacent said rod and said opposite edges of said lid, said cover having mutually facing edges with said lid located therebetween with said opposite edges of said lid spaced apart therefrom limiting contact between said lid and said cover.

10. A debris disposal system including a support with an upwardly facing surface, and having an entrance hole to receive debris on the supporting surface, comprising:

a structure mounted to an upwardly facing surface of a support and extending downwardly from an entrance hole of the support, said structure having a front portion and back portion with space positioned therebetween; and, a receptacle extendable into and removably positioned in said space of said structure, said receptacle having a receptacle front wall, a receptacle rear wall, receptacle side walls and a receptacle bottom wall joined together forming a box;

a pivotably mounted lid and having an open position allowing debris to be swept across the upwardly facing surface into said box and a closed position to limit debris from escaping therefrom; and, a spring device engaged with said lid to assist opening and closing of said lid; and, a cover on said receptacle and having mutually facing edges with said lid located therebetween and spaced apart therefrom limiting contact between said lid and said cover, said cover includes a plurality of opening extending therethrough and being located outwardly of said box to allow air flow from said structure and through said cover.

* * * * *